United States Patent [19]

Mizoguchi et al.

[11] Patent Number: 5,028,277

[45] Date of Patent: Jul. 2, 1991

[54] CONTINUOUS THIN SHEET OF TIAL INTERMETALLIC COMPOUND AND PROCESS FOR PRODUCING SAME

[75] Inventors: Toshiaki Mizoguchi; Kenichi Miyazawa; Toshihiro Hanamura; Naoya Masahashi, all of Kawasaki, Japan

[73] Assignee: Nippon Steel Corporation, Tokyo, Japan

[21] Appl. No.: 483,576

[22] Filed: Feb. 23, 1990

[30] Foreign Application Priority Data

Mar. 2, 1989 [JP] Japan ..... 1-50649

[51] Int. Cl.[5] ..... C22C 14/00; B23K 20/00

[52] U.S. Cl. ..... 148/11.5 F; 148/2; 148/3; 148/403; 148/407; 420/418

[58] Field of Search ..... 148/11.5 F, 2, 3, 403, 148/407; 420/418

[56] References Cited

U.S. PATENT DOCUMENTS 4,354,880 10/1982 Adams et al. ..... 148/2
4,709,572 12/1987 Yamada et al. ..... 148/2
4,830,086 5/1989 Kobayashi et al. ..... 420/488
4,849,168 7/1989 Nishiyama et al. ..... 420/417
4,893,743 1/1990 Eylon et al. ..... 228/190

FOREIGN PATENT DOCUMENTS 61-213361 9/1986 Japan .
62-256902 11/1987 Japan .
63-171862 7/1988 Japan .

OTHER PUBLICATIONS

Kim, Jour. of Metals, Jul. 1989, pp. 24–30.
M. Yamaguchi, "Kinzoku", Jan. 1989, pp. 49–54.
Proceedings of the Japan Institute of Metals, Sep. 21 (1980), pp. 24–27.
H. A. Lipstt et al., Metallurgical Transaction, vol. 6A (1975), pp. 1991–1997.

*Primary Examiner*—Upendra Roy
*Attorney, Agent, or Firm*—Kenyon & Kenyon

[57] ABSTRACT

A continuous thin sheet of a TiAl intermetallic compound consisting of from 35 to 44 wt % Al and the balance Ti and unavoidable impurities, having a thickness of from 0.2 to 3 mm, and having a solidified, as-cast structure comprising columnar crystals extending from both surfaces of the sheet toward the center of the sheet thickness, and a process for producing the same by using a twin-roll type continuous casting procedure.

1 Claim, 3 Drawing Sheets

CONTINUOUS THIN SHEET OF TIAL INTERMETALLIC COMPOUND AND PROCESS FOR PRODUCING SAME

BACKGROUND OF THE INVENTION

1. Field of the Invention

The present invention relates to a uniform, continuous thin sheet of a TiAl intermetallic compound and a process for producing the same by using a twin-roll type continuous casting process.

2. Description of the Related Art

A TiAl intermetallic compound is a lightweight metallic material having a very high strength at elevated temperatures and an excellent resistance to corrosion. For example, a high temperature strength as high as 40 $kg/mm^2$ at 800° C. was reported in Metallurgical Transaction, vol. 6A (1975), p. 1991. Accordingly, due to these high-temperature characteristics thereof, a TiAl alloy is advantageous when used for gas turbine parts, automobile engine valves and pistons, disks and bearings for high temperature use, aircraft frames, and outer plates of ultrasonic passenger airplanes.

Nevertheless, although a TiAl alloy is lightweight and has a high resistance to heat and corrosion, and therefore is suitable for high temperature service such as turbine blades, it is difficult to form same by rolling or forging, due to a poor ductility thereof at room temperature.

Among the above-exemplified applications, a thin sheet of a TiAl intermetallic compound is particularly suitable for use as the outer plates of the airframe of an ultrasonic passenger aircraft, and accordingly, a process for producing a TiAl thin sheet having dimensions such as about 1 mm thick, 30 cm wide, and 30 cm long must be established.

Conventionally, a thin sheet of TiAl intermetallic compound is obtained by cutting an ingot, or by a sheath working as disclosed in Japanese Unexamined Patent Publication (Kokai) No. 61-213361, but a sheet having a length such as described above has not yet been provided. The ingot cutting method has a problem of a poor yield of material and a difficulty of obtaining a uniform compositional distribution due to gravity segregation. Conventional hot plastic-working techniques include sheath working, hydrostatic extrusion, isothermal forging, and hot extrusion, but the current process conditions for these techniques lead to an essential difficulty in that the high strength at elevated temperatures (e.g., 200 MPa at 1050° C.) and high strain-rate dependency of TiAl must be overcome. The above-mentioned J.U.P.P. No. 61-213361 discloses that sheath working requires an S-816 Co-based super alloy sheath and a rolling speed of 1.5 m/min at a rolling temperature of 1100° C. Also, in the proceedings of the Japan Institute of Metals, September 21 (1988), p. 24, it was reported that a strain rate of $10^{-2}$ to $10^{-3}$ $sec^{-1}$ is required at temperatures of from 950 to 1000° C., and this makes it difficult to control the rolling temperature and leads to a low productivity rate.

Moreover, the above-mentioned conventional processes can provide only a small TiAl product having dimensions of, for example, 20 mm long, 10 mm wide, and 10 mm thick, and requires complicated processing steps, and accordingly, much labor and equipment.

Although Japanese Unexamined Patent Publication (Kokai) No. 62-256902 discloses a process for producing a TiAl intermetallic compound by using a fast cooling technique, such as a single roll process or a twin roll process, in which a molten metal is solidified by a fast cooling at a rate of $10^{4}$° C/sec or higher to obtain a solidified product in the form of a flake, it has not yet been reported that a continuous thin sheet of a TiAl intermetallic compound can be obtained.

Consequently, the conventional processes starting from a mass of cast material such as an ingot cannot practically produce a TiAl thin sheet having dimensions such as 1 mm thick, 30 cm wide, and 30 cm long, from the viewpoint not only of the product soundness but also of the productivity rate and the equipment required.

SUMMARY OF THE INVENTION

The object of the present invention is to provide a continuous thin sheet of a TiAl intermetallic compound and a process for easily and efficiently producing the same.

To achieve the above object according to the present invention, there is provided a continuous thin sheet of a TiAl intermetallic compound consisting of from 35 to 44 wt % Al and the balance Ti and unavoidable impurities, having a thickness of from 0.2 to 3 mm, and having a solidified, as-cast structure comprising columnar crystals extending from both surfaces of the sheet toward the center of the sheet thickness.

According to the present invention there is also provided a process for producing a continuous thin sheet of a TiAl intermetallic compound comprising the steps of:

heating a mixture consisting of from 35 to 44 wt % Al and the balance Ti in an inert gas atmosphere to form a melt, continuously feeding the melt to an open-ended mold defined by a pair of cooling rolls and a pair of side dams, the rolls rotating at a peripheral speed of from 0.1 to 10 m/sec, and cooling the melt within the gap by the cooling rolls, while a constant force is applied to the rolls, to form a solidified sheet having a thickness corresponding to the distance between the rolls.

The cooling is preferably effected at a rate of from $10^{2}$ to $10^{5}$° C/sec.

A twin-roll process used in the present inventive process, in which an open-ended mold is defined by a pair of cooling rolls and a pair of side dams, is widely known as a continuous casting process for producing a metallic thin sheet having a thickness of several mm and a width of several tens of cm at a casting speed of several m/sec, and is considered an ideal process for producing a thin sheet of a TiAl intermetallic compound from the viewpoint of the aforementioned desired dimensions for a TiAl thin sheet. The twin-roll process also has an advantage in that it comprises a simple set of process steps by which a final thin sheet product is obtained and enables the omission of some process steps, and thus a reduction of the corresponding equipment and labor required in the conventional processes starting from a massive cast material.

Other processes for producing a thin sheet from a molten metal are known, such as a twin-belt process, a single-belt process, and a single-roll process, but in the process using a belt or belts the cast sheet has a thickness of several cm, which is too thick for a final sheet product, and substantially no labor-saving is obtained, and in the single-roll process, the cast sheet is as thin as several hundreds of μm, which has an insufficient solidified shell strength for the forming of a continuous sheet. The single-roll process has another disadvantage in that cooling is effected from only one side of a casting, which causes a non-uniform solidification and a resulting cracking of the cast material.

The Al content must be in the range of from 35 to 44 wt %, to obtain a uniform TiAl sheet having a structure composed of a TiAl intermetallic compound phase mixed with a minute amount of other phases such as a $Ti_3Al$ phase and a hardness of about 350HV in terms of micro-Vickers hardness number.

The sheet thickness must be in the range of from 0.2 to 3 mm, as a sheet thinner than 0.2 mm will be easily broken during casting or subsequent handling due to a low strength and poor deformability of such a thin sheet. To stably obtain a continuous thin sheet without breakage, the thickness must be 0.2 mm or more. A greater thickness is preferred from this point of view, but a sheet having a thickness of more than 3 mm may occasionally be found to contain a significant amount of voids.

To obtain a sheet having a thickness within the above-specified range, the peripheral speed of the cooling rolls must be within the range of from 0.1 to 10 m/sec. If a direct control of the cooling rate during solidification is possible, the cooling rate is preferably maintained within the range of from $10^5$ to $10^{2°}$ C/sec, which corresponds to the above-specified roll speed.

DESCRIPTION OF THE PREFERRED EMBODIMENTS

Figure 1:
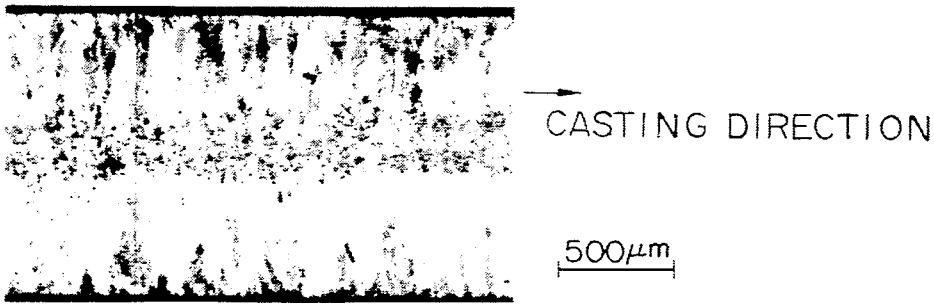
FIG. 1 is a photograph showing an as-cast structure of a solidified TiAl thin sheet according to the invention, in a section along the direction of thickness and in the casting direction.

FIG. 1 shows a solidified, as-cast structure of a TiAl thin sheet according to the present invention. The as-cast structure is substantially composed of columnar crystals extending from both surfaces of the sheet to the center of the sheet thickness with a minute amount of equiaxed crystals at the center of the sheet thickness.

An X-ray diffraction study has shown that a TiAl thin sheet obtained by a twin-roll process has a <111>crystal orientation in the vicinity of the sheet surface.

Figure 3:
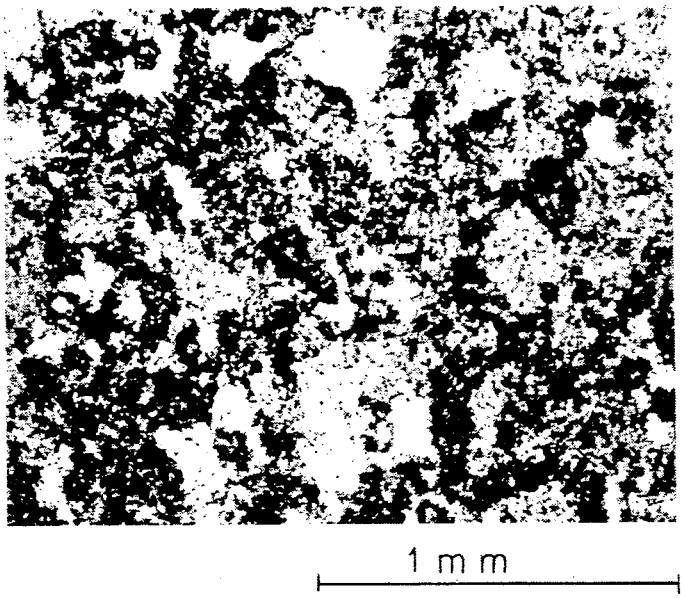
FIG. 3B is a photograph showing a microstructure of a TiAl ingot obtained by a conventional arc-melt method.
Figure 3:
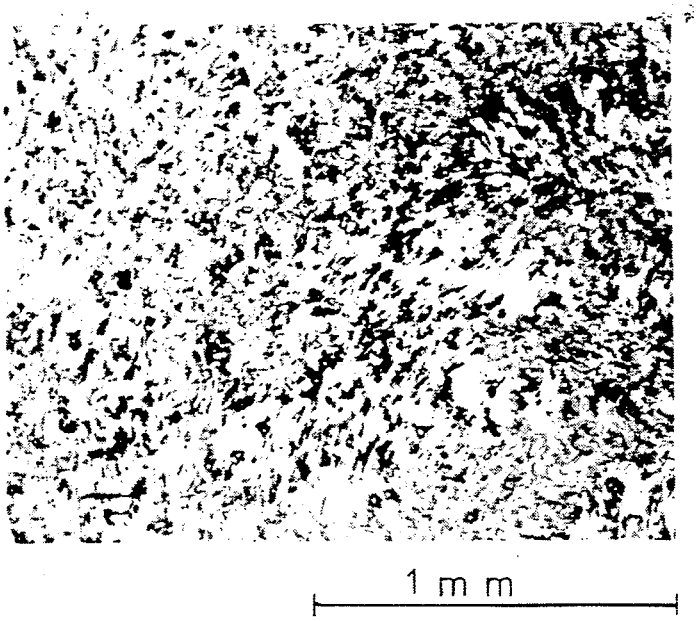

FIG. 3A shows a microstructure of a TiAl thin sheet of the present invention, in which the microstructure is composed of three phases, i.e., a TiAl phase and a minute amount of $Ti_3Al$ and $A1_2Ti$ phases, but a microstructure composed substantially of a single TiAl phase alone can be obtained if the chemical composition of a sheet is appropriately adjusted.

FIG. 3B shows a microstructure of an ingot obtained by a conventional arc-melt method, for comparison.

It is evident from FIGS. 3A and 3B that the absolute amount of the $Ti_3Al$/TiAl lamellar structure is increased in a thin sheet according to the present invention, in comparison with the conventional arc-melt ingot, and that the inter-lamellar spacing is about ten-fold finer in the present inventive thin sheet (about 0.1 μm) than in the conventional arc-melt ingot (about 1 μm).

The increased amount of lamellar structure and the finer lamellar spacing obtained by a fast cooling or rapid solidification process improve the mechanical properties, including the ductility and strength, as reported in "Kinzoku", January (1989), p. 49. The twin-roll process used in the present invention, in which a melt is subjected to a fast cooling on both surfaces by a pair of cooling rolls to effect a rapid solidification, very effectively improves the mechanical properties of a TiAl thin sheet.

A TiAl thin sheet according to the present invention is produced in the following manner.

The Al and the Ti melting stocks are blended in proportions such that the Al amount is 35 to 44 wt %, the mixture is heated in an inert gas atmosphere to a temperature of preferably from 1500° to 1600° C. to form a melt, and the melt temperature is then adjusted to a lower temperature of usually from 1400° to 1500° C. The melt is then continuously fed to a gap or an open-ended mold defined by a pair of cooling rolls and a pair of side dams; the rolls rotating at a peripheral speed of from 0.1 to 10 m/sec. The gap is filled with the melt, and thus an intimate contact is effected between the melt and the peripheral surfaces of the cooling rolls. The melt within the mold or gap is cooled by the cooling rolls, while a constant force is applied to the rolls, to form a cast strand or a continuous sheet having a thickness corresponding to the distance between the rolls.

The melting of the Al-Ti mixture is preferably carried out at the above-mentioned, relatively higher temperature of from 1500° to 1600° C., to facilitate the reaction between Al and Ti and form a uniformly molten compound.

The poor ductility of the TiAl intermetallic compound is a major problem when processing the same, and is important when producing a TiAl thin sheet by using a twin-roll process, since the ductility is closely related to a cracking of a cast strand during cooling and solidification. A non-uniform cooling or solidification over the cast strand width is considered to be the main cause of the cracking of the less ductile TiAl casting. Therefore, to prevent such cracking, it is necessary to eliminate possible phenomena causing a non-uniform solidification, such as a non-uniform melt stream fed to the gap or open-ended mold and a resistance to a heat conduction between the melt and the cooling rolls caused by, for example, an oxide film formed on the melt meniscus surface. To obtain a uniform melt stream to be fed to the gap, preferably a melt feeding nozzle in the form of a slit is used. The oxide film formation on the meniscus surface is eliminated by carrying out the melting of the Al-Ti mixture in an inert gas atmosphere, such as Ar, He, etc., which are inactive and do not react with Al or Ti in the molten state.

Preferably, to mitigate the cracking of a cast strand, the non-solidified volume retained in the center of strand thickness is minimized when the cast strand is passing the point (often referred to as "kissing point") at which the distance between two cooling rolls is at a minimum. To effect this, the cooling rolls are not rigidly fixed but are resiliently supported by using a spring, etc., to urge the solidified shell with a constant force in such a manner that the gap between two rolls opens automatically in accordance with the growth of the solidified shell.

Another way of mitigating the cracking of the cast strand is to thoroughly eliminate a solidifed fringe occasionally formed on the side edges of a cast strand, since this solidifed fringe suppresses the transverse contraction of a solidified shell and generates a stress which will cause cracking. This type of cracking source usually can be eliminated by controlling the force pressing a pair of side dams against the end faces of the cooling rolls.

Figure 2:
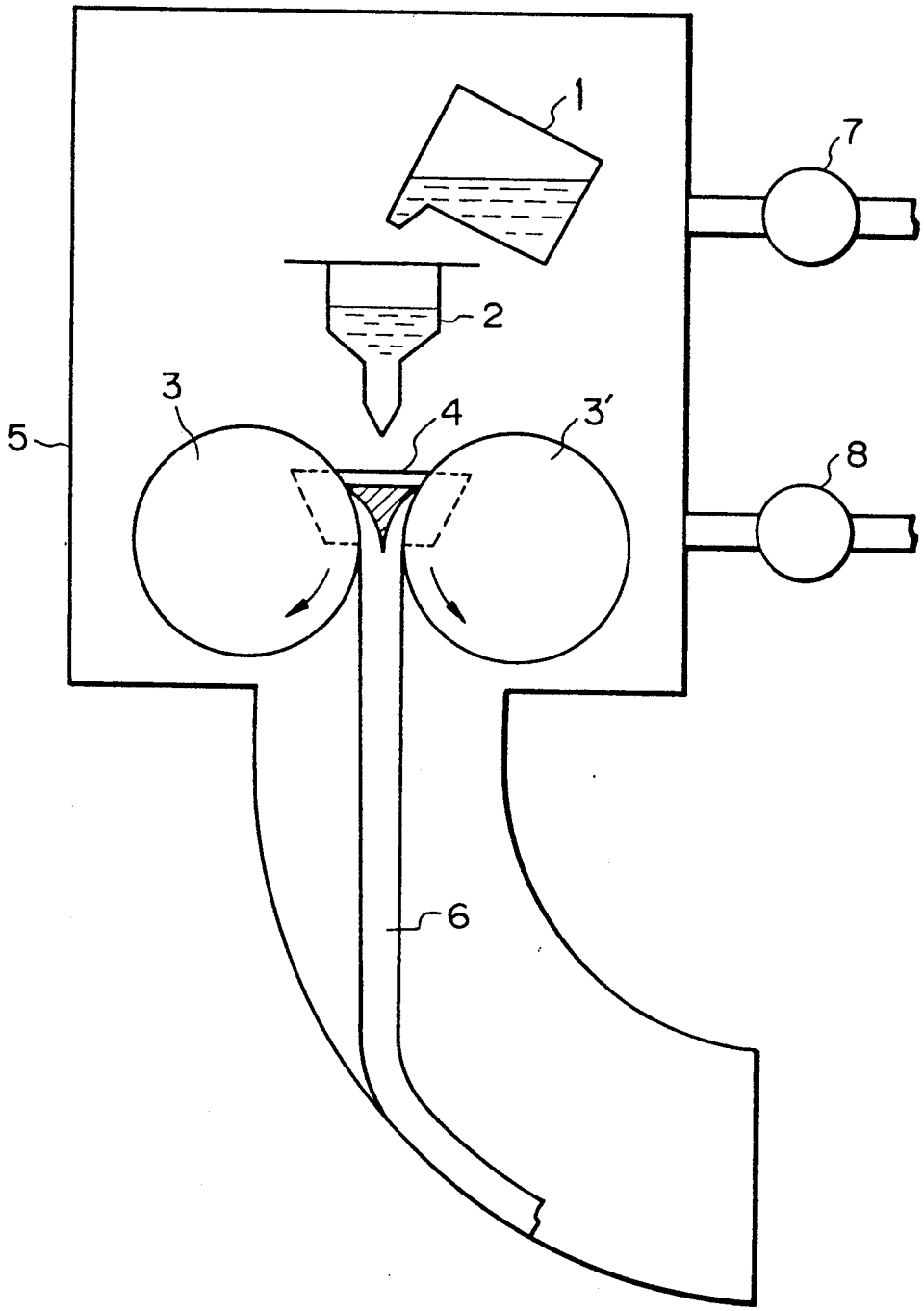
FIG. 2 shows an arrangement for carrying out a process for producing a TiAl thin sheet according to the present invention; and, FIG. 3A is a photograph showing a microstructure of a TiAl thin sheet according to the present invention

FIG. 2 shows a twin-roll type continuous casting arrangement for producing a TiAl thin sheet according to the present invention. A TiAl intermetallic compound is melted in a crucible 1, from which the melt is poured into a tundish 2 made of a refractory material. The tundish 2 has a feeding slit at the bottom for uniformly feeding a melt stream to a gap between a pair of cooling rolls 3, 3', over the width of the cooling rolls 3, 3'. A pair of side dams 4 are pressed against the end faces of the cooling rolls 3, 3'to define a sealed gap or an open-ended mold in which the fed melt forms a pool. A solidified cast strand or a TiAl thin sheet product 6 is discharged downward from the gap or mold between the cooling rolls 3, 3'. The TiAl in the molten state is protected against air-oxidation by a container 5 which covers the crucible 1, the tundish 2, and the cooling roll/side dam setup. Before starting the melting of a Ti-Al mixture in the crucible 1, the container 5 is evacuated through an evacuating system 8 and an inert gas such as Ar, He, etc., is then introduced through a gas introducing system 7.

EXAMPLE

A thin sheet of a TiAl intermetallic compound was produced according to the present invention by using an twin-roll type continuous casting apparatus shown in FIG. 2.

An aluminum melting stock and a sponge titanium were blended to form a mixture having a composition of 36 wt % Al and 64 wt % Ti, and an 8 kg mass from the mixture was charged into a crucible 1 and was heated to 1600° C. until a uniform melt was formed. The melt temperature was then adjusted to a lower temperature of 1500° C., the melt was poured into a tundish 2 having a feeding slit 4 mm wide and 95 mm long, and the melt was fed therefrom to a gap between a pair of cooling rolls 3, 3' made of copper and having a diameter of 300 mm and a width of 100 mm, to form a melt pool having a height of about 80 mm. The pressure on the cooling rolls was kept at constant value, and the cooling roll peripheral speed was varied, whereby the cooling rate was correspondingly varied from $10^2$ to $10^{5}$° C/sec and TiAl continuous thin sheets having various sheet thicknesses were obtained as shown in Table 1. The obtained sheet length ranged from 3 to 10 m.

TABLE 1

| Peripheral speed of cooling rolls (m/s) | Sheet thickness (mm) |
|---|---|
| 0.31 | 1.9 |
| 0.47 | 1.6 |
| 0.72 | 1.4 |
| 1.26 | 0.9 |
| 5.00 | 0.5 |

The section of the thus-obtained thin sheets exhibited an as-cast structure substantially the same as that shown in FIG. 1, i.e., columnar crystals extended from both surfaces of a sheet to the center of the sheet thickness, and in some samples, the structure also contained a minute amount of equiaxed crystals at the center of the sheet thickness, other than the columnar crystals. An X-ray diffraction analysis showed that these sheets had a preferred crystal orientation <111>in the surface region.

A microscopy showed that the sheets had a microstructure substantially the same as that shown in FIG. 3A. The microstructures were composed of three phases, i.e., a TiAl phase and a minute amount of $Ti_3Al$ and $Al_2Ti$ phases, but a microstructure composed to the TiAl phase alone could be obtained by adjusting the chemical composition of the sheet.

The absolute amount of the $Ti_3Al$/TiAl lamellar structure in a thin sheet is increased according to the present invention, in comparison with the conventional arc-melt ingot such as shown in FIG. 3B, and the interlamellar spacing is about ten-fold finer in the present inventive thin sheet (about 0.1 μm) than in the conventional arc-melt ingot (about 1 μm).

The average crystal grain sizes were about 100 μm, which is about five-fold finer than those of the conventional arc-melt ingot.

The sheet had a micro-Vickers hardness number of 350HV at any measuring point throughout the sheet, which hardness is comparable with those of conventional TiAl products produced by an arc-melt method, etc.

The present invention provides a continuous thin sheet of a TiAl intermetallic compound having a thickness of from 0.2 to 3 mm. The present inventive process using a twin-roll type continuous casting process enables the mass-production of a uniform and economical TiAl thin sheet, without difficulty, and a reduction of the labor and equipment indispensable in the conventional processes starting from a massive cast material and requiring complicated process steps, such as powder metallurgy, cutting an ingot, hot plastic-working, etc.

What is claimed is:

1. A continuous thin sheet of a TiAl intermetallic compound consisting of from 35 to 44 wt. % Al and the balance Ti and unavoidable impurities, having a thickness of from 0.2 to 3 mm, and having a solidified, as-cast structure comprising columnar crystals extending from both surfaces of the sheet toward the center of the sheet thickness.

* * * * *